United States Patent [19]

Felthuis et al.

[11] Patent Number: 4,863,378

[45] Date of Patent: Sep. 5, 1989

[54] CERAMIC BURNER FOR A HOT-BLAST STOVE

[75] Inventors: Jacob Felthuis, Alkmaar; Ronald J. M. Stokman, Hillegom, both of Netherlands

[73] Assignee: Hoogovens Groep B.V., Ijmuiden, Netherlands

[21] Appl. No.: 234,597

[22] Filed: Aug. 22, 1988

[30] Foreign Application Priority Data

Aug. 31, 1987 [NL] Netherlands ..... 8702037

[51] Int. Cl.[4] ..... C21B 9/00

[52] U.S. Cl. ..... 432/217; 432/181; 432/222; 431/170; 431/185

[58] Field of Search ..... 432/181, 30, 217, 40, 432/218, 222; 431/158, 190

[56] References Cited

U.S. PATENT DOCUMENTS

| | | | |
|---|---|---|---|
| 4,086,052 | 4/1978 | Laux et al. | 432/217 |
| 4,259,064 | 3/1981 | Laux et al. | 431/170 |
| 4,313,724 | 2/1982 | Muller et al. | 431/170 |
| 4,369,954 | 1/1983 | Palz | 432/217 |
| 4,508,504 | 4/1985 | Eschmann et al. | 432/217 |
| 4,582,485 | 4/1986 | White, Jr. | 431/170 |

*Primary Examiner*—Henry C. Yuen

*Attorney, Agent, or Firm*—Stevens, Davis, Miller & Mosher

[57] ABSTRACT

A ceramic burner for a hot blast stove, having a burner head where the combustion components mix and an air duct and a gas duct beneath the head for conducting combustion components to the head, the gas duct is within the air duct and is bounded by a wall. To prevent stresses due to differences of thermal expansion at least one horizontal sliding joint is arranged in the bounding wall of the gas duct closely under the burner head. The air duct is bounded by a brickwork wall which continues upwardly past the burner head and forms a combustion chamber. The burner head projects over and is supported by a shoulder in this wall and an essentially vertical expansion joint is located between the burner head and the wall.

3 Claims, 1 Drawing Sheet

CERAMIC BURNER FOR A HOT-BLAST STOVE

BACKGROUND OF THE INVENTION

1. Field of the Invention

The invention relates to a ceramic burner for a hot-blast stove, e.g. for a blast furnace, comprising a burner head at which the combustion components meet and an air duct and a gas duct underneath the burner head.

2. Description of the Prior Art

A ceramic burner of this type is disclosed in NL-A-No. 8201238. In this example, the gas duct is formed within the air duct by a monolithic structure or a brickwork structure whose courses contain means hindering their relative movement.

A problem with these high temperature burners is that, because of thermal expansions, during operation and during construction their dimensions are considerably different. A further problem is that the burner has local expansion differences due to differences in temperature in the burner structure. Means of interlocking are used against movement of the courses of the structure and have the function of preventing gas leaks caused by periodically occurring expansion differences. However, the interlocking in combination with the expansion differences give rise to stresses in the burner which reduce its service life.

DE-A- No. 3240852 discloses a burner in which a sliding joint is provided in the brickwork of the burner head itself.

SUMMARY OF THE INVENTION

The object of the invention is to create a burner structure which, despite the use of a monolithic structure or of means preventing relative movement, suffers no gas leaks and yet displays only a small stress build-up during normal operation. In this way the service life of the burner may be prolonged.

In the ceramic burner in accordance with the invention, in one aspect, at least one horizontal sliding joint is arranged in the bounding wall of the gas duct closely under the burner head.

The invention is based on the realization that the temperature gradient is greatest in the area of the burner head. Directly above the burner head temperatures of about 1600° C. prevail, while in the brickwork beneath the burner head the temperature does not usually exceed 200° C. It has been found possible to position the sliding joint, which reduces or prevents stress build-up, in the area of this high temperature gradient without gas leaks being caused. Such gas leaks would be expected just here where expansion differences are at their greatest.

Based on the same considerations behind this invention, the invention provides in a second aspect a ceramic burner of the type described at the outset in which the air duct has a brickwork outer wall which extends to above the burner head and forms a combustion chamber for the hot blast stove. The burner head projects over and is supported by a shoulder in this outer wall and an essentially vertical expansion joint is incorporated between the burner head and the outer wall.

In this case the burner head rests on the outer wall of the air duct as well as on the brickwork of the gas duct. With this design, the burner head has a hinge-point in the outer wall of the air duct and can move freely relative to that outer wall without the possibility of gas leaks occurring. If there is a greater expansion in the brickwork of the gas duct than in the outer wall of the air duct, the burner head hinges on its hinge point in the outer wall, but stays resting on both the brickwork of the gas duct and the outer wall of the air duct. As a result of this the gas seal remains assured.

Preferably the vertical expansion joint widens upwardly. This has the advantage that even large expansion differences between brickwork of the gas duct and the outer wall of the air duct do not give rise to physical contact between the burner head and the outer wall of the air duct. This extensively prolongs the service life of the burner.

BRIEF INTRODUCTION OF THE DRAWING

An embodiment of the invention will be described below by way of non-limitative example with reference to the single figure of the accompanying drawing, which shows a ceramic burner in accordance with the invention.

DESCRIPTION OF THE PREFERRED EMBODIMENT

Figure 1:
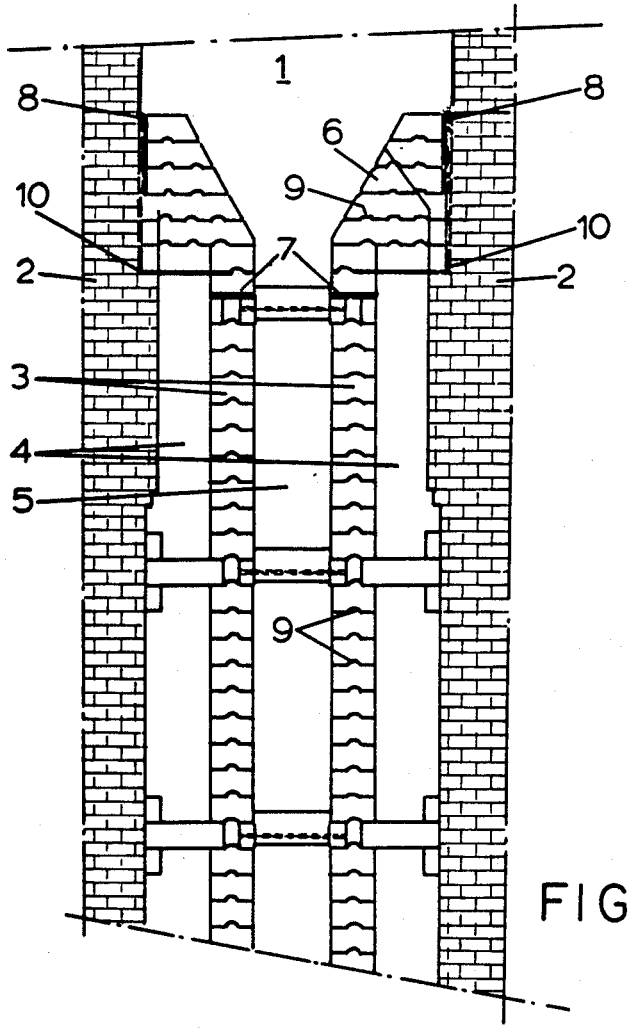

The figure shows a ceramic burner of a hot blast stove having a burner head 6 below a combustion chamber 1 and above vertical supply ducts 4,5 for combustion air and gas respectively. At the burner head, these combustion components meet and mix. The flame temperature achieved in this combustion can be about 1600° C., while the temperature of the combustion gases and the combustion air of the ducts 4,5 is a maximum of about 200° C.

The gas duct 5 is bounded by a wall formed of free-standing brickwork 3 positioned in the annular air duct 4. The air duct 4 is bordered at its inside by the brickwork 3 and at its outside by a brickwork wall 2. The wall 2 extends upwardly beyond the burner head 6 and there forms the combustion chamber 1. The figure shows that the adjacent courses of the brickwork 3 and of the burner collar 6 are secured together against relative movement by tongue and groove 9. It is also possible to use other securing means for this purpose, within the invention.

The invention is also applicable in a burner built of a flameproof concrete, which by virtue of its monolithic structure does not require any such means preventing movement of courses.

In accordance with the invention, a horizontal sliding joint 7 is arranged in the brickwork wall 3 closely under the burner head 6. In this case the sliding joint 7 is one course below the bottom of the burner head. This sliding joint absorbs the effects of differences of thermal expansion in and adjacent the burner head.

The burner head 6 is lapped into the outer wall 2, i.e. the burner head projects into the outer wall 2 and is supported by a shoulder at point 10 in the outer wall 2. Between the burner 6 and the outer wall 2, an essentially vertical expansion joint 8 is located. With this design a gas-tight structure is obtained avoiding any stress build-up in the burner which could affect its service life. This is achieved because this design provides a hinge-point 10 in the outer wall 2 at which the burner head 6 hinges when there are expansion differences between the brickwork wall 3 and the outer wall 2. The structure remains gas-tight during hinging because the burner head 6 stays continuously on both the brickwork wall 3 and the outer wall 2. Preferably the vertical expansion joint 8 widens upwardly. This means that even with very great expansion differences between the brickwork 3 and the outer wall 2, the structure itself stays gas-tight, because damage to the burner head 6 as a result of engagement between the burner head 6 and the outer wall 2 is avoided.

The sliding joint 7 and the expansion joint 8 may be of conventional type.

We claim:

1. Ceramic burner for a hot blast stove, comprising a burner head at which the combustion components mix, and air duct, a gas duct, both said ducts being beneath the head for conducting combustion components to the head, said gas duct being formed within the air duct and bounded by a bounding wall which consists of one of (a) a monolithic structure and (b) brickwork having, for a majority of its courses, means preventing relative movement of the courses and at least one horizontal sliding joint in said bounding wall of the gas duct positioned closely under the burner head.

2. Ceramic burner for a hot blast stove, comprising a burner head at which the combustion components mix, an air duct, a gas duct, both said ducts being beneath the head for conducting combustion components to the head, said gas duct being within the air duct, said air duct being bounded at its outside by a brickwork wall which continues upwardly past the burner head and forms a combustion chamber above the burner head, said wall having a shoulder in its interior surface adjacent the burner head, said burner head projecting over and being supported by said shoulder in said brickwork wall and an essentially vertical expansion joint provided between the burner head and said brickwork wall.

3. Ceramic burner according to claim 2 wherein said vertical expansion joint widens upwardly.

* * * * *